United States Patent [19]

Tyler

[11] Patent Number: 4,802,817

[45] Date of Patent: Feb. 7, 1989

[54] CENTRIFUGAL PUMP WITH SELF-REGULATING IMPELLER DISCHARGE SHUTTER

[75] Inventor: Thomas R. Tyler, Rockford, Ill.

[73] Assignee: Sundstrand Corporation, Rockford, Ill.

[21] Appl. No.: 137,163

[22] Filed: Dec. 23, 1987

[51] Int. Cl.[4] ..... F01D 17/08

[52] U.S. Cl. ..... 415/157; 415/49

[58] Field of Search ..... 415/157, 49, 148, 158, 415/159

[56] References Cited

U.S. PATENT DOCUMENTS

| | | | |
|---|---|---|---|
| 2,846,185 | 8/1958 | Widmer | 415/157 |
| 3,784,318 | 1/1974 | Davis | 415/158 |
| 4,643,639 | 2/1987 | Caine | 415/148 |

FOREIGN PATENT DOCUMENTS

| | | | |
|---|---|---|---|
| 133892 | 9/1929 | Switzerland | 415/158 |
| 305214 | 1/1929 | United Kingdom | 415/158 |

*Primary Examiner*—Robert E. Garrett
*Assistant Examiner*—John T. Kwon
*Attorney, Agent, or Firm*—Wood, Dalton, Phillips, Mason & Rowe

[57] ABSTRACT

A centrifugal pump having a self-regulating impeller discharge shutter which controls the size of flow passages from the pump impeller to the volute according to the flow demand on the pump. When the pump is operating at the design flow rate, the flow passages can be nearly fully open and, when there is a lesser demand, the area of the flow passages can be correspondingly reduced to improve stability and minimize the temperature rise within the pump. The position of the impeller discharge shutter is automatically controlled by exposure to the static pressure at the tip of the impeller and the pressure in the volute which exert oppositely-acting forces on the impeller discharge shutter.

7 Claims, 1 Drawing Sheet

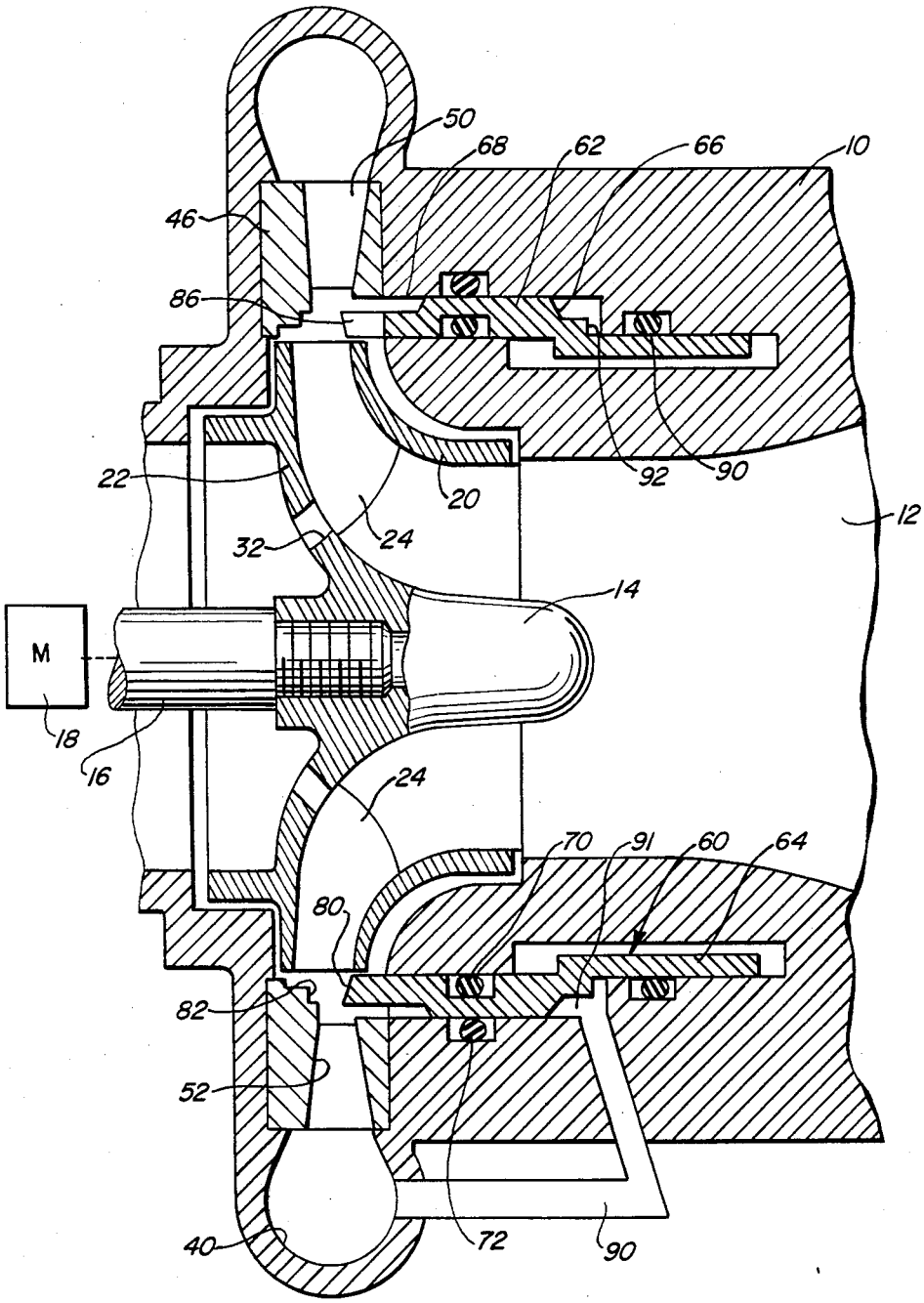
50
68
62
66
10
46
86
22
20
92
90
12
32
24
14
M
18
16
24
70
91
60
64
80
82
52
40
72
90

CENTRIFUGAL PUMP WITH SELF-REGULATING IMPELLER DISCHARGE SHUTTER

FIELD OF THE INVENTION

This invention relates to centrifugal pumps and, more particularly, to a centrifugal pump having a self-regulating impeller discharge shutter effective at flow rates substantially less than the designed flow rate to provide stability and low temperature rise.

BACKGROUND OF THE INVENTION

Centrifugal pumps of conventional design have their components designed to operate at maximum efficiency at their design flow rate. When a centrifugal pump is required to deliver less than the design flow, the pump wastes considerable power, with this power being dissipated in large part as an increase in the temperature of the fluid being pumped and with potential for instability in operation.

Proposed solutions to the foregoing problems inherent in operation of a centrifugal pump at relatively low flow rates less than design flow rate are disclosed in the Davis U.S. Pat. No. 3,784,318 and a patent owned by the assignee of this application, namely, Caine U.S. Pat. No. 4,643,639.

The Davis patent discloses the use of a variable diffuser valve which can be positioned at any one of various selected positions to throttle the pump discharge by partial closing of diffuser entry passages adjacent the tips of the impeller blades. The Davis patent also describes a prior art structure using a diffuser inlet shutter. Servo means control the position of either the variable diffuser valve or the diffuser inlet shutter.

The Caine patent has a valve, in the form of a hollow cylinder 42, positionable by operation of an external actuator to control the position thereof relative to the entry end of a plurality of diffuser passages and with certain of the diffusers constructed to have portions of the passages remain open, even when the valve is seated on its seat.

The known prior art does not disclose a centrifugal pump having a self-regulating impeller discharge shutter automatically positionable in response to the pressure relation between the static pressure at the tips of the impeller blades and the pressure in the volute surrounding the impeller to throttle the flow delivered by the impeller to the volute.

SUMMARY OF THE INVENTION

A primary feature of the invention is to provide a new and improved centrifugal pump and, more particularly, to provide a centrifugal pump having a self-regulating impeller discharge shutter whereby, with the pump requiring variable flow rates, the impeller discharge shutter is operable at low flow rates to control pump stability and minimize the temperature rise of the fluid being pumped.

An illustrative embodiment of the invention having the aforesaid features comprises a centrifugal pump having a housing with an inlet in which a rotatable impeller is mounted. A volute extends about the impeller and is spaced radially outwardly therefrom with a plurality of diffusers positioned in the flow path between the impeller and the volute. An impeller discharge shutter, in the form of a cylindrical member, is movably mounted in the housing in surrounding radially-spaced relation with the impeller. A forward section of the impeller discharge shutter is variably positionable in the flow path between the impeller and the volute and has an end of the forward section defining an area exposed to tip static pressure at the tip of the impeller. A remote opposite end of the impeller discharge shutter is exposed to volute pressure whereby the impeller discharge shutter forward section is variably positionable in the flow path at certain flow rates below design flow rate and dependent upon the values of tip static pressure and the volute pressure acting oppositely on the impeller discharge shutter.

An object of the invention is to provide a centrifugal pump comprising: a housing; an inlet for said housing; an impeller rotatably mounted within said housing; an outlet volute extending about said impeller and spaced radially outwardly therefrom; and an impeller discharge shutter variably positionable for controlling the rate of fluid flow from the impeller to the volute and positionable in direct response to static pressure at the tip of the impeller and volute pressure.

Still another object of the invention is to provide a centrifugal pump as defined in the preceding paragraph wherein said impeller discharge shutter is a cylindrical member and there are a plurality of diffusers positioned between the impeller and the volute and downstream of the impeller discharge shutter.

Still another object of the invention is to provide a centrifugal pump as defined in the preceding paragraphs wherein at least one throat is formed in the impeller discharge shutter to permit limited pump flow when the impeller discharge shutter is mechanically closed against a seat.

A further object of the invention is to provide a centrifugal pump comprising: a housing; an inlet for said housing; an impeller rotatably mounted within said housing; an outlet volute extending about said impeller and spaced radially outwardly therefrom; a plurality of diffusion passages having progressively increasing or constant cross sections in a flow path between the impeller and volute; and a movable shutter variably positionable in the flow path in response to static pressure at the tip of the impeller and volute pressure acting directly thereon.

DESCRIPTION OF THE DRAWINGS

The FIGURE is a fragmentary, central sectional view of a centrifugal pump embodying the invention.

DESCRIPTION OF THE PREFERRED EMBODIMENT

The centrifugal pump has a housing 10, part of which is shown in the FIGURE, and which has an inlet 12 for flow of fluid to an impeller 14 rotatably mounted within the housing by mounting thereof on a rotatable shaft 16 suitably supported in the housing by bearings (not shown) and having a drive source, such as a motor 18.

The impeller and radial seal structure are of a conventional construction, with the impeller having a front shroud 20 and a rear shroud 22 and a plurality of vanes 24 between the shrouds having their tips at the impeller tip. The rear shroud 22 has a series of openings 32 in order to communicate the space to the rear of the rear shroud with the inlet side of the impeller.

The housing has a collector, in the form of an outlet volute 40 surrounding and radially-spaced from the impeller and which has an outlet (not shown) through which pumped fluid is discharged from the pump.

A diffusion structure defines a series of diffusion passages extending from the outer periphery of the impeller to the volute 40. The diffusion structure is defined by an annular member 46 in the housing between the impeller and the volute. The annular member 46 has a circumferential series of diffusion passages with the diffusion passages 50 and 52 being seen in the FIGURE and which may be, but not necessarily, of increasing cross section in the direction of the volute 40.

The foregoing structure is similar to that shown in the aforesaid Caine patent and the disclosure thereof is incorporated by reference.

An impeller discharge shutter, indicated generally at 60, is movably mounted within the housing 10 for throttling pump flow by varying the opening of the flow passages from the impeller to the volute. The impeller discharge shutter 60 can be in the form of a two-diameter, generally cylindrical member having a forward section 62 and a rear section 64 which are interconnected by a sloped section 66. The impeller discharge shutter can move to either side of an intermediate position, shown in the FIGURE.

The forward section 62 is sealed within an annular channel 68 formed in the housing by a pair of annular seal members 70 and 72. These seal members can be in the form of O-rings or piston rings, with the seal member 70 shown as being carried by the forward section 62 and the other seal member 72 shown as being fitted in a groove in the housing. These mountings can be reversed. The forward section 62 has an annular end 80 which, in the closed position of the impeller discharge shutter, can seat against an annular seat 82, formed at the inner end of the member 46. The end 80 of the forward section 62 of the impeller discharge shutter is formed with at least one throat, shown at 86, whereby, when the end of the impeller discharge shutter is seated against the valve seat, there is still at least one throat permitting limited flow from the impeller to the volute. The end 80 may be, but is not required to be, sloped for exposure to impeller tip static pressure even when the impeller discharge shutter is mechanically closed.

The rear section 64 of the impeller discharge shutter has its inner surface spaced from the adjacent wall of the cavity in the housing receiving the impeller discharge shutter whereby there is a balance of any pressure that may be acting on opposite ends thereof and the outer peripheral surface of the rear section 64 is sealed to the housing by an annular seal member 90.

With the centrifugal pump operating at a design flow rate, the impeller discharge shutter is positioned to the right of the intermediate position shown in the FIGURE. When there is very low flow demand on the pump, the impeller discharge shutter is positioned to the left of the intermediate position shown in the FIGURE and, at minimal flow, the end 80 thereof is seated against the valve seat. With the impeller discharge shutter mechanically closed, there is still limited pump flow through the throat or throats 86.

The impeller discharge shutter is self-regulating in operation and is positioned to achieve a pressure balance between $P_V$, which is the fluid pressure existing in the volute 40 and $P_T$, which is static pressure of the fluid at the impeller tip.

Normally, $P_V$ is greater than $P_T$ because of a conversion of fluid velocity pressure to static pressure in the volute. Although not essential to the invention to have the diffuser passages 52, there is also a static pressure rise occurring in the diffuser which contributes to $P_V$ being greater than $P_T$.

$P_T$ acts upon the annular end 80 of the forward section 62 of the impeller discharge shutter and $P_V$ acts on an area at the opposite end of the forward section. The pressure $P_V$ is applied through a passage 90, formed in part externally of the housing and in part by a passage in the housing 10 and which communicates the volute 40 with an annular space 91 in the housing. Pressure is applied to the sloped surface 66 as well as a surface 92, with the surfaces 66 and 92 defining an annular area which can be adjusted for various flow rates or, as shown, can be equal to that of the end 80 of the forward section. One or more additional passages 90 can connect the volute 40 to the annular space 91.

Normally $P_V$ is greater than $P_T$ because of static pressure rise in the volute as well as across the diffuser and, therefore, the imbalance in pressures would cause the impeller discharge shutter to normally be closed. At a high flow rate, the opening defined by the position of the end 80 of the forward section of the impeller discharge shutter defines an orifice with pressure drop thereacross and, therefore, $P_V$ can be less than $P_T$ and the imbalance in pressures will cause the impeller discharge shutter to be positioned toward the right, as viewed in the FIGURE, to increase the flow passage area. If the impeller discharge shutter should fully close mechanically against its seat, then $P_T$ will be greater than $P_V$, and the impeller discharge shutter will automatically open. Instead of the impeller discharge shutter cycling back and forth between open and closed positions, it finds some equilibrium intermediate position.

The control provided by the impeller discharge shutter automatically positioned in response to the relation between $P_V$ and $P_T$ enables stable operation of the centrifugal pump at flow rates substantially below the design flow rate and provides for a low temperature rise in the pumped fluid.

The desirability of limiting the amount of fluid being pumped by a centrifugal pump when there is a low flow demand is well recognized in the prior art. The invention disclosed herein provides for such operation by controlled positioning of an impeller discharge shutter without any external control applied thereto, but merely by the impeller discharge shutter responding to static pressure at the tip of the impeller and the fluid pressure in the volute with the pressures applied in opposition directly thereto.

I claim:

1. A centrifugal pump comprising:

a housing, an impeller rotatable in said housing;

an outlet volute extending about said impeller;

an impeller discharge shutter movably mounted in said housing in surrounding radially-spaced relation with said impeller with a forward section variably positionable in a flow path between the impeller and the volute and having an end exposed to tip static pressure at the tip of the impeller; and means communicating a remote opposite end portion of the impeller discharge shutter with volute pressure whereby the impeller discharge shutter forward section, at certain flow rates, is variably positionable in said flow path dependent upon the values of said tip static pressure and said volute pressure, said end of the impeller discharge shutter and said remote end portion thereof being of constant area constantly exposed to said tip static pressure and volute pressure respectively, in all the variable positions of the impeller discharge shutter whereby said variable positions are determined solely by the relative values of tip static pressure and volute pressure applied to the constant areas of the impeller discharge shutter.

2. A centrifugal pump as defined in claim 1 wherein a plurality of diffusers are positioned in said flow path between the impeller and the volute and downstream of said impeller discharge shutter.

3. A centrifugal pump as defined in claim 1 wherein the impeller discharge shutter can mechanically close against a seat, with at least one throat formed in the forward section of the impeller discharge shutter to permit limited pump flow when the impeller discharge shutter is seated against said seat.

4. A centrifugal pump as defined in claim 1 wherein said impeller discharge shutter is a cylindrical member.

5. A centrifugal pump comprising:

a housing;

an impeller rotatable in said housing;

an outlet volute extending about said impeller;

a plurality of diffusers between the impeller and the outlet volute;

an impeller discharge shutter defined by a cylindrical member movably mounted in said housing with a forward section variably positionable in a flow path between the impeller and the diffusers and having an end exposed to tip static pressure at the tip of the impeller with said end being closable against a seat;

means communicating a remote opposite end portion of the impeller discharge shutter cylindrical member with volute pressure whereby the impeller discharge shutter forward section is variably positionable in said flow path dependent upon the relative values of said tip static pressure and said volute pressure acting in opposition on said impeller discharge shutter cylindrical member; and said end of the impeller discharge shutter and said remote end portion thereof being of constant area constantly exposed to said tip static pressure and volute pressure respectively, in all the variable positions of the impeller discharge shutter whereby said variable positions are determined solely by the relative values of tip static pressure and volute pressure applied to the constant areas of the impeller discharge shutter.

6. A centrifugal pump as defined in claim 5 wherein the areas of the impeller discharge shutter cylindrical member exposed to tip static pressure and volute pressure, respectively, are equal.

7. A centrifugal pump as defined in claim 5 wherein at least one throat is formed in the forward section of the cylindrical member to permit limited pump flow when the cylindrical member is closed.

* * * * *